United States Patent [19]

Kunst et al.

[11] 4,062,702

[45] Dec. 13, 1977

[54] PROCESS FOR PARTIALLY INSULATING SURFACES OF METAL WORK PIECES

[75] Inventors: Helmut Kunst; Christian Scondo, both of Hanau, Germany

[73] Assignee: Deutsche Gold- und Silber-Scheideanstalt Vormals Roessler, Frankfurt, Germany

[21] Appl. No.: 605,296

[22] Filed: Aug. 18, 1975

[30] Foreign Application Priority Data

Aug. 29, 1974 Germany ..... 2441309

[51] Int. Cl.[2] ..... C21D 1/48; C22B 35/00

[52] U.S. Cl. ..... 148/14; 148/16; 148/16.6; 148/31.5; 427/197; 427/252; 428/538; 148/27

[58] Field of Search ..... 148/14, 16, 16.6, 31.5, 148/27, 20, 20.3, 6.11; 427/197, 207, 227, 383, 272, 282, 287, 300, 318, 327, 372, 380, 252, 253; 428/469, 538, 539, 540, 920

[56] References Cited

U.S. PATENT DOCUMENTS

| | | | |
|---|---|---|---|
| 2,367,978 | 1/1945 | Troy | 148/16.6 |
| 2,788,302 | 4/1957 | Dew | 148/16.6 |
| 3,904,789 | 9/1975 | Speirs et al. | 427/253 |

*Primary Examiner*—Walter R. Satterfield

*Attorney, Agent, or Firm*—Cushman, Darby & Cushman

[57] ABSTRACT

Portions of the surface area of metal workpieces are insulated in thermochemical treatment by covering the areas with a self-adhering textile tape having metal powder embedded in its adhesive layer.

21 Claims, No Drawings

PROCESS FOR PARTIALLY INSULATING SURFACES OF METAL WORK PIECES

The invention concerns a process for insulating portions of the surface area in the thermochemical treatment of metals by covering these portions.

In the thermochemical treatment of metals, for example in the nitriding, boriding, siliciding or vanadiding of iron workpieces, titanium or other metals in practice there is frequently the need to exclude specific portions of the surfaces of such workpieces from this treatment, i.e. to insulate. In the mentioned thermochemical treatment there are generally formed hard, frequently also brittle, layers which are neither solderable nor weldable. Therefore, the insulation of specific portions of a workpiece has only the object to be able to subsequently solder or weld these portions which are still workable. Besides there can possibly be placed on the surfaces which are excluded from the thermochemical treatment other requirements in regard to slip behavior, errosion behavior, electrical or magnetic properties.

There are known in the practice several processes for insulation of portions of the surface areas of workpieces in the thermochemicl treatment which, however, are only suited for specific processes or do not fulfill the requirements for complete insulation. Thus, for insulation in gas nitriding pastes are used which contain certain organic and metal compounds and are set up by dipping or brushing. For insulation in bonding in baths or powders there is possible, for example, an insulation only by a 0.1 to 0.25 mm thick pore-free galvanically established copper layer or by covering with a correspondingly thick copper sheet.

Until now no usable means has been known for covering nitriding baths. In the practice sometimes there were employed workpieces of suitable form in which the part not to be treated projected out of the nitriding bath. In this case, however, it is necessary to protect the workpiece part which pushes through the bath surface by wrapping it with an aluminum foil.

Therefore, it was the problem of the present invention to find a universally usable process which permits the most complete insulation possible of specific (e.g. predetermined) workpiece parts. Furthermore, the corresponding covering agents should be easy to apply and the residue after the resulting treatment should be easy to remove. Finally, there cannot be permitted to take place by its use any injury or fouling of the treating medium, as for example, nitriding bath.

This problem is solved according to the invention by covering the corresponding surface areas with a self-adhering textile tape, in which adhesive layer there is embedded metal powder.

As metal powders there can be used either pure metals, e.g. copper, tin, silver, nickel or aluminum or mixtures or alloys of two or more metals, e.g. copper-tin, nickel-silver, copper-nickel-aluminum. There is especially mentioned the addition of cadmium and/or lead in an amount of up to 10% of the metals just mentioned. Thus, there can be added to 10% of cadmium and/or lead. Besides employing metal powders there can also be used powdery metal compounds of the above-mentioned, or other, metal, for example oxides, halides or sulfides. Thus, there can be added to 30% of such oxides, halides or sulfides, e.g. cupric oxide, alumina, stannic oxide, nickel oxide, cupric sulfide, cupric chloride, silver chloride, nickel chloride, aluminum chloride, etc.

With the process of the invention it is possible to insulate predetermined portions of workpieces in a simple and reliable manner since these covering tapes can be applied to the spots to be insulated by pasting onto the places to be insulated.

The requisite insulation is complete, there are formed no thermochemical treatment layers on the coated surface portions. The tape and adhesive burn or carbonize during the thermochemical treatment to a nearly residue-free condition. The thin metal layers still remaining, in case it is necessary, can be easily removed mechanically or chemically.

The coating process of the invention can be used in place of all previously known and practically used thermochemical treatments.

The thickness of the adhesive layer of the textile tape used which can be made, for example, from natural fibers such as cotton fibers, or synthetic fibers such as polyamide (nylon) or polyethylene, or polypropylene or polyester, e.g. polyethylene terephthalate, is preferably 25 to 250 mμ, the thickness of the metal powder layer 10–200 mμ.

In boriding copper powder has been found especially good, while in salt bath nitriding tin powder has been found especially good.

Unless otherwise indicated, all parts and percentages are by weight.

The following examples further illustrate the process of the invention.

EXAMPLE 1

Commercial steels of different compositions, as for example CK 15, 42 Cr Mo 4 or 60 W Cr V 7, and cast iron were borided in a known boriding powder (90% silicon carbide, 5% boron carbide, 5% potassium borofluoride) for 3 hours at 900° C. Specific portions of these workpieces were coated by a tape which consisted of a cotton fabric which in its 100 mμ thick adhesive layer contained a mixture of 95% copper powder and 5% tin powder in a layer thickness of about 30 mμ. While the non coated areas had a hardness of 1700 to 2000 HV 1, (Vickers hardness, measured with a load of 1 kp) the coated areas only had a hardness of 95 to 200 HV 1, depending on the type of steel. Residues were not detectable on the workpieces.

EXAMPLE 2

Boriding was carried out as in Example 1 but at higher temperature (1000° C.) and for a longer time (7 hours). The tape and composition of the metal mixture were the same as in Example 1 but the thickness of the metal layer was 60 mμ and the thickness of the adhesive layer was 150 mμ. The hardness values obtained corresponded to those of Example 1.

EXAMPLE 3

Workpieces of CK 15 steel were nitrided at 580° C. in a salt bath containing 35 to 40% $CNO^-$, 1 to 2% $CN^-$. (The composition was made of 72 kg KCNO, 21.8 kg $Na_2CO_3$, 6,2 kg $K_2CO_3$ and 2.3 kg KCN).

Specific work surface areas were completely insulated by covering with tapes of cotton fabric having embedded in the adhesive layer metal powders of the following compositions:

a. pure tin
b. 90% tin, 10% copper
c. 72% silver, 28% copper
d. 90% copper, 10% copper oxide The coated spots had neither an iron nitride compound layer nor a diffusion zone.

The process can comprise, consist essentially of or consist of the steps set forth and the compositions of the metal powder can comprise, consist essentially of or consist of the materials set forth.

The textile fabric is normally made of organic polymer material.

What is claimed is:

1. A process for insulating portions of the surface area of a metal workpiece which is to be subjected to thermochemical treatment comprising coating predetermined portions of said workpiece with a self-adhesive fibrous textile tape made of organic material, having embedded in the adhesive layer thereof a metal powder and thereafter subjecting the workpiece to thermochemical treatment at a temperature sufficient to destroy said tape, said adhesive layer of the tape having a thickness of 25 to 250 microns and the metal powder having a thickness of 10 to 200 microns.

2. A process according to claim 1 wherein the workpiece is made of iron or steel.

3. A process according to claim 2 wherein the metal powder comprises copper, tin, silver, nickel or aluminum.

4. A process according to claim 3 wherein the metal powder also includes lead, cadmium or a mixture of lead and cadmium in an amount of up to 10% of the total metal powder.

5. A process according to claim 3 wherein the metal powder layer also contains a metal compound which is a metal oxide, metal halide or metal sulfide in an amount of up to 30% of the total of metal powder and metal compound.

6. A process according to claim 5 wherein the metal compound is an oxide, halide or sulfide of copper, tin, silver, nickel or aluminum.

7. A process according to claim 6 wherein the metal compound is an oxide.

8. A process according to claim 1 wherein the thermochemical treatment is either a boriding or a nitriding treatment.

9. A process according to claim 8 wherein the treatment is boriding.

10. A process according to claim 8 wherein the treatment is nitriding.

11. A process according to claim 8 wherein the metal powder comprises copper, tin, silver, nickel or aluminum.

12. A process according to claim 1 wherein the coating is accomplished by pasting the tape onto the places to be insulated.

13. A process according to claim 1 wherein the tape is carbonized in the thermochemical treatment.

14. A process according to claim 1 wherein the thermochemical treatment is vanadiding.

15. A process according to claim 1 wherein the thermochemical treatment is siliciding.

16. A process comprising subjecting to thermochemical treatment at a temperature sufficient to destroy the tape thereon a metal workpiece having predetermined areas thereof coated with a self-adhesive fibrous textile tape made of organic material, having embedded in the adhesive layer thereof a metal powder whereby said predetermined areas are insulated when the workpiece is treated thermochemically, the adhesive layer of the tape having a thickness of 25 to 250 microns and the metal powder having a thickness of 10 to 200 microns.

17. A process organic to claim 16 wherein the workpiece is made of iron or steel.

18. A process according to claim 17 wherein the tape is made of an organic polymer.

19. A process according to claim 18 wherein the metal powder comprises copper, tin, silver, nickel or aluminum.

20. A process according to claim 19 wherein the thermochemical treatment is a boriding or nitriding treatment.

21. A metal workpiece made of iron or steel suitable for thermochemical treatment having predetermined areas thereof coated with a self-adhesive fibrous textile tape made of organic material, having embedded in the adhesive layer thereof a metal powder comprising copper, tin, silver, nickel or aluminum whereby said predetermined areas will be insulated when the workpiece is treated thermochemically, the tape adhesive layer having a thickness of 25 to 250 microns and the metal powder having a thickness of 10 to 200 microns.

* * * * *